US005132674A

United States Patent [19]

Bottorf

[11] Patent Number: 5,132,674

[45] Date of Patent: Jul. 21, 1992

[54] METHOD AND APPARATUS FOR DRAWING HIGH QUALITY LINES ON COLOR MATRIX DISPLAYS

[75] Inventor: Scott A. Bottorf, Cedar Rapids, Iowa

[73] Assignee: Rockwell International Corporation, Seal Beach, Calif.

[21] Appl. No.: 363,431

[22] Filed: Jun. 6, 1989

Related U.S. Application Data

[63] Continuation of Ser. No. 113,033, Oct. 22, 1987, abandoned.

[51] Int. Cl.[5] ..... G09G 5/04

[52] U.S. Cl. ..... 340/728; 340/747

[58] Field of Search ..... 340/728, 747, 791, 793, 340/723, 701, 703

[56] References Cited

U.S. PATENT DOCUMENTS

| | | | |
|---|---|---|---|
| 4,119,956 | 10/1978 | Murray . | |
| 4,215,414 | 7/1980 | Huelsman . | |
| 4,237,457 | 12/1980 | Houldsworth . | |
| 4,354,186 | 10/1982 | Groothuis . | |
| 4,370,646 | 1/1983 | Mahony . | |
| 4,408,198 | 10/1983 | Kudirka . | |
| 4,586,037 | 4/1986 | Rosener et al. | 340/728 |
| 4,591,844 | 5/1986 | Hickin et al. | 340/728 |
| 4,604,614 | 8/1986 | Farr et al. . | |
| 4,612,540 | 9/1986 | Pratt | 340/793 |
| 4,704,605 | 11/1987 | Edelson | 340/728 |

OTHER PUBLICATIONS

IBM Tech. Disc. Bul. "Anti-aliasing Video Look-up Table", vol. 27, No. 108, Mar. 1985 pp. 6339-6342.

*Primary Examiner*—Jeffery A. Brier
*Assistant Examiner*—Richard Hjerpe
*Attorney, Agent, or Firm*—Gregory G. Williams; M. Lee Murrah; H. Fredrick Hamann

[57] ABSTRACT

A method and apparatus for drawing high quality lines on color matrix displays wherein a line segment is created by activating a series of linear elements substantially centered about the predetermined line segment position and providing for various intensities for each element, the notion of a pixel group is completely discarded and each individual display element is individually addressed and individually assigned an intensity depending upon the predetermined line segment to be displayed and the orientation of that line segment wherein the method comprises generating element intensity, position and line slope information for a given line segment; inverting and registering the element intensity information; centering an array of elements around the element position information; determining the color of elements in the array of elements; determining the proper intensity for each element in the array of elements in order to produce the predetermined position of the line; and providing the proper intensity for each element and the array of elements in order to provide the proper line color.

8 Claims, 3 Drawing Sheets

METHOD AND APPARATUS FOR DRAWING HIGH QUALITY LINES ON COLOR MATRIX DISPLAYS

This Application is a continuation of application Ser. No. 07/113,033 filed Oct. 27, 1987, now abandoned.

CROSS REFERENCE

This application relates to the subject matter of a co-pending application by L. R. Strathman et al entitled "Automatic Synthetic Dot Flair for Flat Panel Displays" filed on the same date herewith and assigned to the same assignee, the Ser. No. of which is 113,046; and the subject matter is hereby incorporated by reference.

BACKGROUND OF THE INVENTION

This invention generally relates to displays and more particularly concerns color matrix displays and even more particularly relates to color matrix displays having high position resolution and image quality requirements.

Presently, across the display industry, there is a significant effort underway to increase the image quality and position resolution of characters upon color matrix displays. Typically, color matrix displays consist of a regular patterned array of separately addressable elements, with each element corresponding to one of the three preferred colors; red, green and blue. This element matrix is common to liquid crystal displays, thin film electroluminescent displays, etc. Frequently, it is desirable to have a high information content display and in such applications the character image quality and the position resolution become increasingly important.

One type of matrix display that has been commonly used in the past is a delta matrix where each pixel is treated much like a pixel in a CRT. During line drawing the independent separate color matrix elements are grouped into pixels each having one red, one blue and one green element. This pixel or picture element arrangement is discussed in Section 1.6 on pages 18–21 of *Flat Panel Displays and CRT's* by Lawrence E. Tannis Jr. published by VanNostrand Reinhold Company, of New York, N.Y., which is incorporated herein by this reference.

While this pixel approach has been utilized extensively in the past it does have several serious drawbacks. One predominant drawback of such a design is that when a diagonal line is drawn across the display matrix, the line frequently appears jagged. Another problem with such a design is that the position resolution of any line drawn upon the matrix is limited by the pixel size. Additionally, the pixel approach does not allow computation of a unique intensity of each element within the pixel, thereby reducing the intensity resolution of the display.

Consequently, there exists a need for an improved color matrix display which provides for improved character position resolution and improved character image quality.

SUMMARY OF THE INVENTION

It is an object of the present invention to provide a color matrix display having an improved character line quality.

It is a feature of the present invention to energize a series of linear elements, with varying intensities for each line segment to be displayed.

It is an advantage of the present invention to create an intensity distribution about the line segment which allows for a smoother line image quality.

It is another object of the present invention to provide an increased anti-aliasing capability.

It is another feature of the present invention to vary the intensity of the linear element group associated with each line segment.

It is another advantage of the present invention to provide increased position resolution by creating an apparent image position which is variable and controllable in dimensions smaller than the element dimension.

The present invention is designed to satisfy the aforementioned needs, produce the above described objects, include the previously stated features and produce the earlier articulated advantages. The present invention is a "pixel-less" color matrix display, in the sense that, when lines for display characters are drawn; the notion of a pixel is completely disregarded. Instead, the character line segments are drawn by addressing each individual element. Furthermore, a line segment is created by activating a series of linear elements substantially centered about the predetermined line segment position and providing for various intensities for each element.

Accordingly, the present invention includes the method and apparatus for drawing high quality lines upon a color matrix display where an image point is produced by selectively and independently energizing a series of linear elements roughly centered around the predetermined line segment position.

BRIEF DESCRIPTION OF THE DRAWINGS

The invention may be more fully understood by reading the following description of a preferred embodiment of the invention in conjunction with the appended drawings wherein.

DETAILED DESCRIPTION

Figure 1:
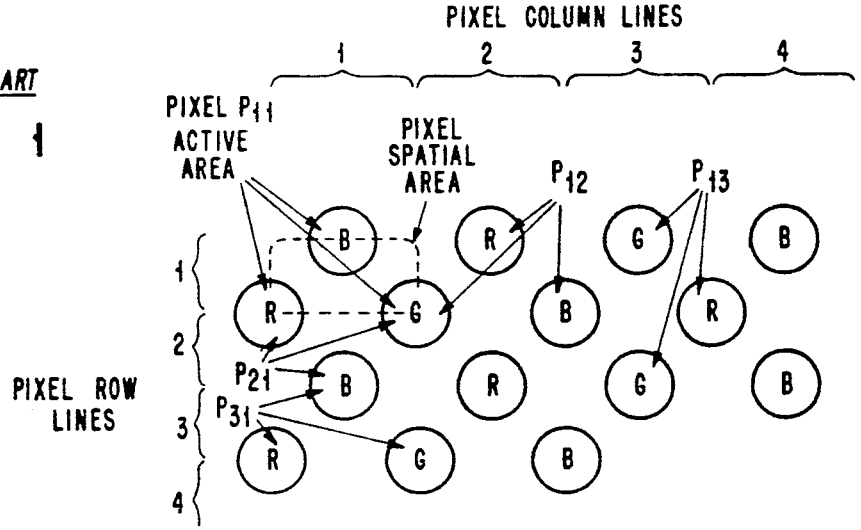
PRIOR ART FIG 1
FIG. 1 is a schematic representation of a prior art display matrix which utilizes separate elements grouped into pixel groups.

Now referring to the drawings, and more particularly to FIG. 1, there is shown a matrix from a prior art display which shows the grouping together of individual elements into pixel configurations. In such an arrangement the display positional resolution is a function of pixel spatial dimensions. Display engineers who have used this pixel type approach have typically considered the pixel to be the lowest resolvable spatial incremental quantum and therefore have generated the lines in the characters by logically treating the pixels as the smallest element.

Figure 2:
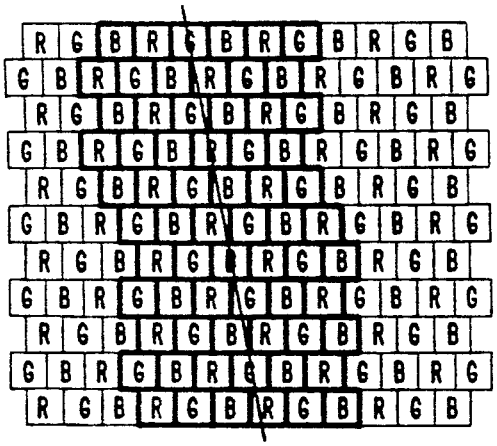
FIG. 2 is a schematic representation of a delta type color matrix display where the diagonal line represents the predetermined position and orientation of a line to be drawn upon the matrix while the linear individual elements roughly centered about this line and outlined by a heavy line are represented as being independently activated.

Now referring to FIG. 2 there is shown a delta type color matrix array which is shown being addressed by the method and apparatus of the present invention. The diagonal line represents the predetermined central position and orientation of a line drawn upon the display. The six linear elements roughly centered about each line segment and outlined in heavier lines are representative of the elements to be individually activated in order to draw any particular line segment. Six linear elements have been chosen in this particular design, but more or less elements may be used depending upon the particular requirement of a given display and the panel configuration. The color of the line segment and its apparent position to the viewer are a function of the intensity of each of the six linear elements. By selecting the appropriate intensity for each of the six elements, the line segment can be made to appear centered at a location which is not centered over one particular element, thereby allowing for an increase in positional resolution. This resolution improvement allows for an improved line quality for diagonal lines and tends to eliminate or greatly reduce any jagged edges or steps in a displayed line which is intended to be a smooth diagonal.

Figure 3:
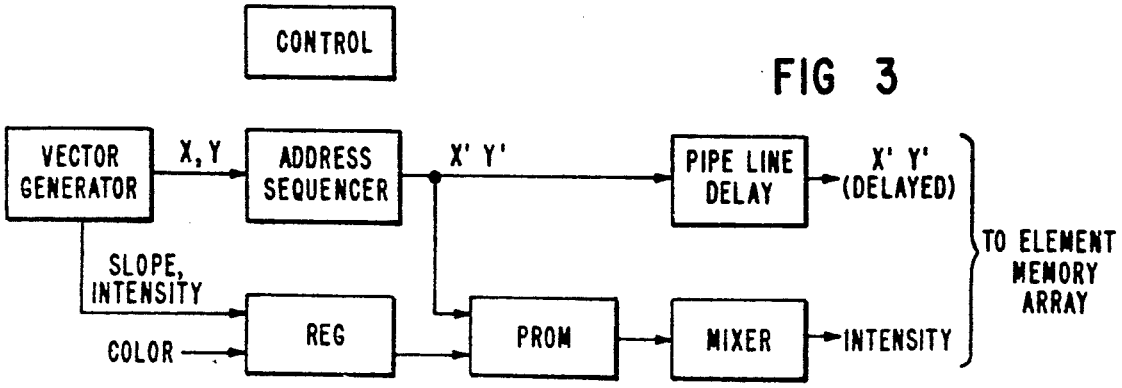
FIG. 3 is a schematic representation of the present invention in its intended environment with a vector generator as an input and an element memory array as an output.

The invention can be more clearly understood by referring to FIG. 3 which is a schematic overview representation of the present invention as it relates to a typical vector generator and a common raster memory. The output of the vector generator is position slope sub-element error information.

Figure 4A:
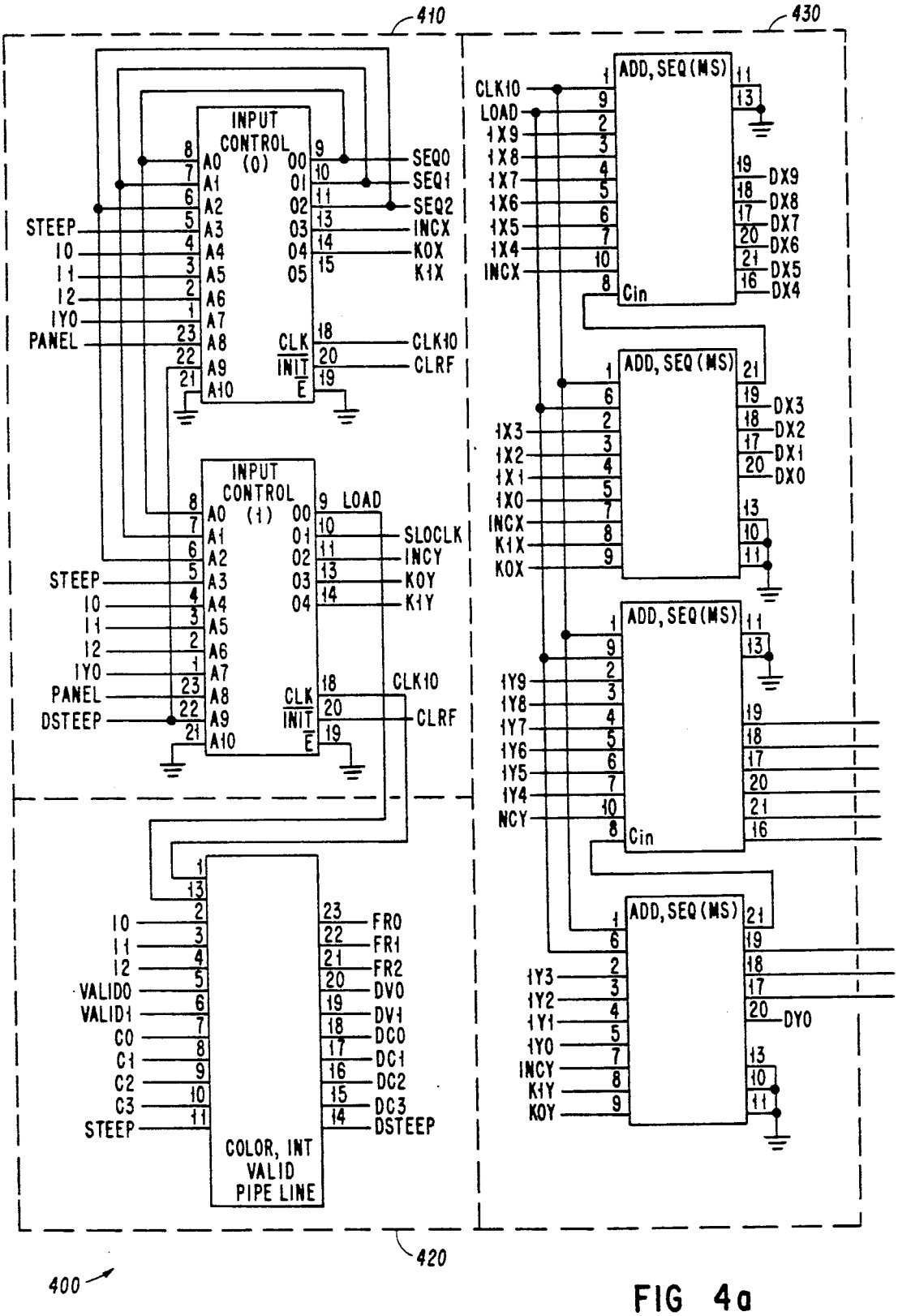
FIG. 4*a* and 4*b* is a more detailed schematic representation of a circuit of the present invention.
Figure 4B:
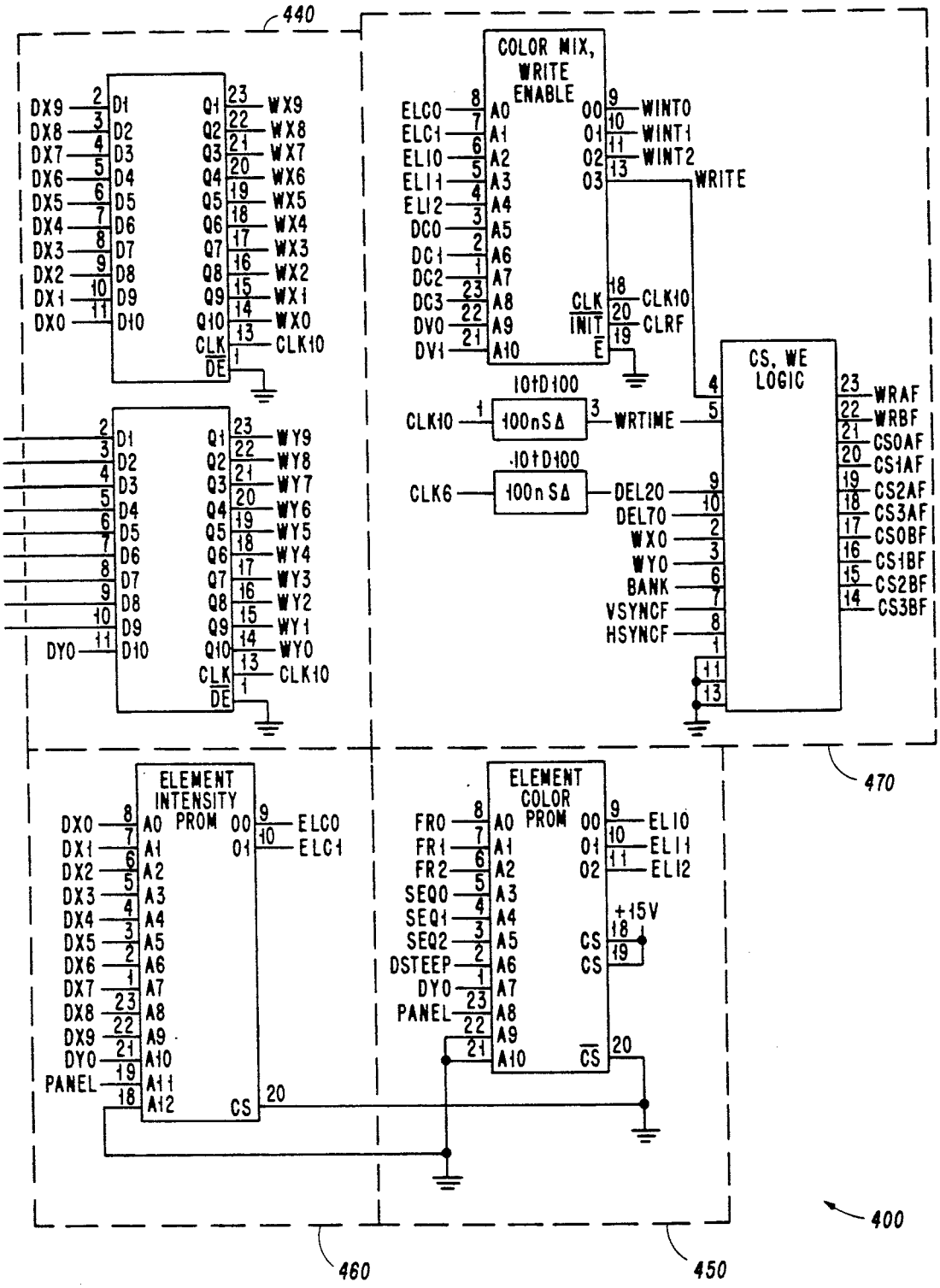

Now referring to FIG. 4*a* and 4*b* there is shown a more detailed schematic representation of the line drawing circuit of the present invention, generally designated 400, which contains an input control block 410 which receives input from a vector generator block, not shown, which consists of a two gate array set which interpolates between line segment end point values. The gate arrays output X and Y values, and an intensity value corresponding to the difference between the logical position of the line and the integer value output as a dependent variable. Arrays use the slope of the line (i.e. steep or shallow) to select whether X or Y is the independent variable. Also output are slope and output valid signals. And EPLD is used as a pipeline register for line color.

The input control block 410 receives the following inputs from the vector generator: the intensity outputs, the least significant bit of the Y output, the slope bit. Other inputs include a bit signifying the type of panel being driven and a registered copy of the slope bit. The outputs of the block are used to control the function of the address sequencer block 430 and the color/intensity/valid pipeline block 420, to clock the, gate arrays of the vector generator, and identify the count within the slice of elements being generated. Preferably the input control block is implemented using Cypress CY7C245 registered EPROMs but any suitable EPROM or PROM could be substituted. The software for the input control block is shown in Pascal and is included in the Appendix.

The color/intensity/valid pipeline block 420 provides a pipeline stage for line color, validity, and slope. The intensity output for the gate arrays of the vector generator are inverted and registered. Preferably block 420 is implemented using Cypress C22V10 PAL. The logic for this PAL is provided in the Appendix.

The address sequencer block 430 receives the X Y addresses from the gate arrays of the vector generator and control signals from the input color block 410. The address sequencers can perform the following operations: hold the current value, increment the current value, load the input value, subtract 1 or 2 from the input and load. Block 430 is used to modify the X and Y values for the gate arrays of the vector generator to center the slice about the predetermined value. The independent variable is loaded directly and then held, the dependent variable is loaded with a subtract and then incremented to generate the addresses for each element within the slice. Preferably block 430 is implemented using Cypress C22V10 PALS.

The address pipeline block 440 provides a delay stage for outputs of the address sequencer block 430 and preferably 74ACT821 registers are used for this function.

Element color block 450 receives the X address and the least significant bit of the Y address from the address sequencer 430 and the panel bit. With this information the filter color of the currently addressed element is determined. Preferably the element color block 450 is implemented with a Cypress CY7C263 EPROM. The software for this EPROM are described in the Appendix.

Element intensity block 460 receives the slope and inverted intensity bits from the color/intensity/valid pipeline block 420, the sequence count from the input control block 410, the panel bit, and the Y least significant bit from the address sequencer block 430. Block 460 determines the proper intensity for anti-aliasing of the addressed element without regard to predetermined line color. Preferably this function is implemented with a Cypress CY7C291 EPROM. The software for this EPROM are disclosed in the Appendix.

The color mix/CS,WE logic block 470 preforms the last step of the color mixing, combining the element color outputs from the element color block 450 with the intensity output from the element intensity block 460 and the predetermined line color. It make the final determination of intensity and whether or not to actually write the elements into the element memory, not shown (Elements of zero intensity are not written so as to avoid over writing picture information.) Also within this block are write timing and chip select decode logic to control write operations in a dual bank element memory. Preferably block 470 is implemented with a Cypress CY7C245 EPROM and a C22V10 PAL and two digital delay elements. The software code for the programmable devices is described in the Appendix.

It is thought that the method and apparatus for drawing high quality line on color matrix displays of the present invention, and many of its intended advantages, will be understood from the foregoing description, and it will be apparent that various changes may be made in the form, construction, and arrangement of the parts thereof, without departing from the spirit and scope of the invention, or sacrificing all of their material advantages, the forms hereinbefore being merely preferred or exemplary embodiments thereof. It is the intention of the appended claims to cover all of such changes.

APPENDIX

```
PARTNO NONE;
NAME COLORPIP;
REV 00;
DATE 3/20/87;
DESIGNER SCOTT BOTTORF;
COMPANY COLLINS GOVERNMENT AVIONICS;
ASSEMBLY COLOR LCD GRAPHICS GENERATOR;
LOCATION Uxx;
DEVICE C22v10;

/*************************************************************************/
/* A PIPELINE REGISTER FOR LINECOLOR, GATE ARRAY INTENSITY, AND VALIDITY     */
/*   BITS. IT IS CLOCKED BY THE 10 MHz WRITE CIRCUIT CLOCK AND ENABLED       */
/*   BY THE ADDRESS SEQUENCER ENABLE SIGNAL                                  */
/*************************************************************************/

/*  ****** ALLOWABLE DEVICE TYPES: C22v10 ******** */

/*  ****** INPUTS ******************************** */

PIN 1 = CLK        ;
PIN 2 = I0         ;/* INTENSITY LSB                          */
PIN 3 = I1         ;
PIN 4 = I2         ;
PIN 5 = V0         ;/* VALIDITY LSB                           */
PIN 6 = V1         ;
PIN 7 = C0         ;/* LINE COLOR LSB                         */
PIN 8 = C1         ;
PIN 9 = C2         ;
PIN 10 = C3        ;
PIN 11 = STEEP     ;/*LINE SLOPE INDICATOR                    */
PIN 13 = L         ;/* LOAD ENABLE                            */

/*  ****** OUTPUTS ******************************** */

PIN 23 = FR0       ;/* FRACTIONAL PART OF DEPENDENT VARIABLE */
PIN 22 = FR1       ;/* FR BITS ARE THE INVERSE OF I0:2        */
PIN 21 = FR2       ;
PIN 20 = DV0       ;/* REGISTERED V0                          */
PIN 19 = DV1       ;
PIN 18 = DC0       ;/* COLOR LSB                              */
PIN 17 = DC1       ;
PIN 16 = DC2       ;
PIN 15 = DC3       ;
PIN 14 = DSTEEP    ;/* DELAYED STEEP BIT                      */

/* OUTPUTS ALWAYS ENABLED */

/*      ************* LOGIC EQUATIONS ***************       */

FR0.D = L&!I0 # !L&FR0;
FR1.D = L&!I1 # !L&FR1;
FR2.D = L&!I2 # !L&FR2;
DV0.D = L&V0 # !L&DV0;
DV1.D = L&V1 # !L&DV1;
DC0.D = L&C0 # !L&DC0;
DC1.D = L&C1 # !L&DC1;
DC2.D = L&C2 # !L&DC2;
DC3.D = L&C3 # !L&DC3;
DSTEEP.D = L&STEEP # !L&DSTEEP;
FR2.D = L&!I2 # !L&FR2;
```

```
PARTNO NONE;
NAME CSLOGIC;
REV 01;
DATE 8/26/87;
DESIGNER SCOTT BOTTORF;
COMPANY COLLINS GOVERNMENT AVIONICS;
ASSEMBLY COLOR LCD GRAPHICS GENERATOR;
LOCATION Uxx;
DEVICE C22v10;

/*****************************************************************************/
/* THIS DEVICE COMPRISES THE CHIP SELECT AND WRITE ENABLE LOGIC FOR BOTH     */
/*      BANKS OF RASTER MEMORY. TIMING IS PROVIDED BY DELAYED CLOCK SIGNALS  */
/*      BANK A IS SELECTED FOR INPUT AND BANK B IS OUTPUT WHEN THE BANK      */
/*      SIGNAL IS LOW                                                        */
/*****************************************************************************/

/* ****** ALLOWABLE DEVICE TYPE: C22v10 ******* */

/* ****** INPUTS ****************************** */

PIN 5 = WRTIM        ;/* TIMING SIGNAL FOR INPUT WRITE CYCLES      */
PIN 4 = WRITE         ;/* DENOTES A VALID WRITE CYCLE               */
PIN 9 = DEL20         ;/* 20 nS DELAY OF THE 6 MHz OUTPUT CLOCK     */
PIN 10 = DEL70        ;/* 70 nS DELAY OF THE 6 MHz CLOCK            */
PIN 2 = WX0           ;/* THE LSB OF THE INPUT X ADDRESS            */
PIN 3 = WY0           ;/* THE Y LSB                                 */
PIN 6 = BANK          ;/* THE BANK SELECT LINE                      */
PIN 7 = VSYNCF        ;/* VERTICAL SYNC  (active low )              */
PIN 8 = HSYNCF        ;/* HORIZONTAL SYNC  (active low )            */

/* ****** OUTPUTS ****************************** */

PIN 23 = WRAF         ;/* WRITE ENABLE BANK A  (active low)         */
PIN 22 = WRBF         ;/* WRITE ENABLE BANK B                       */
PIN 21 = CS0AF        ;/* BANK A CHIP SELECT 0                      */
PIN 20 = CS1AF        ;/*                    1                      */
PIN 19 = CS2AF        ;/*                    2                      */
PIN 18 = CS3AF        ;/*                    3                      */
PIN 17 = CS0BF        ;/* BANK B CHIP SELECT 0                      */
PIN 16 = CS1BF        ;/*                    1                      */
PIN 15 = CS2BF        ;/*                    2                      */
PIN 14 = CS3BF        ;/*                    3                      */

/* ****** LOGIC EQUATIONS ********************** */

WRAF = BANK & (DEL20 # !DEL70)                    ;
WRBF = !BANK & (DEL20 # !DEL70)                   ;
CS0AF = !(!BANK&WRITE&!WX0&!WY0&WRTIM # BANK&VSYNCF&HSYNCF)      ;
CS1AF = !(!BANK&WRITE&!WX0&WY0&WRTIM # BANK&VSYNCF&HSYNCF)      ;
CS2AF = !(!BANK&WRITE&WX0&!WY0&WRTIM # BANK&VSYNCF&HSYNCF)      ;
CS3AF = !(!BANK&WRITE&WX0&WY0&WRTIM # BANK&VSYNCF&HSYNCF)      ;
CS0BF = !(BANK&WRITE&!WX0&!WY0&WRTIM # !BANK&VSYNCF&HSYNCF)      ;
CS1BF = !(BANK&WRITE&!WX0&WY0&WRTIM # !BANK&VSYNCF&HSYNCF)      ;
CS2BF = !(BANK&WRITE&WX0&!WY0&WRTIM # !BANK&VSYNCF&HSYNCF)      ;
CS3BF = !(BANK&WRITE&WX0&WY0&WRTIM # !BANK&VSYNCF&HSYNCF)      ;

program elecolor:input.out;

*****************************************************************************

this program generates the data file for blowing the element color PROM
     for the color LCD graphics generator. the PROM used is an 8K x 8
     CMOS EPROM (cy7c263)

     MODIFIED  5/11/87 to conform to actual panel configuration

*****************************************************************************
}
```

```
type
    color_type=(red,green,blue);

var
    x,y0,panel:integer;
    color:color_type;
    outfile:text;
    addr:lstring(15);
    databyte:lstring(8);


{
*****************************************************************************
procedure process_address: generates the address field of the output line
*****************************************************************************
}

procedure process_address;

var
    index,temp:integer;

begin
  addr:=' 0000000000000/';
  temp:=x;
  for index:=0 to 9 do      {convert address to ascii string}
  begin
    if (temp mod 2 =1) then addr[14-index]:='1';
    temp:=temp div 2;
  end;  {address loop}
  if y0=1 then addr[4]:='1';
  if panel=1 then addr[3]:='1';
end;  {procedure process_address}

{
*****************************************************************************
procedure process_data: determines the color of the element at the given
                        address given the type of display panel
*****************************************************************************
}

procedure process_data;

begin
  databyte:='00000000';
  case panel of
    0:case y0 of        {0=> quad panel}
        0:case (x mod 2) of        {even row}
            0:color:=red;
          end;  {even rows, quad panel}
        1:case (x mod 2) of        {odd rows}
            0:color:=green;
            1:color:=blue;
          end;  {odd rows, quad panel}
      end;  {quad panels}
    1:case y0 of       {1=> delta panel}
        0:case (x mod 3) of        {even rows}
            0:color:=red;
            1:color:=green;
            2:color:=blue;
          end;  {even rows, delta panel}
        1:case (x mod 3) of        {odd rows}
            0:color:=blue;
            1:color:=red;
            2:color:=green;
          end;  {odd rows, delta panel}
      end;  {delta panels}
  end;  {outer case}
  case color of                    {generate output word}
    red:begin
        end;    {red code is 00}
    green:databyte[8]:='1';
```

```
    blue:databyte[7]:='1';
  end;  {case}
  writeln(outfile,addr,databyte);
end;  {procedure process_data}


{
*****************************************************************************

                        MAIN PROGRAM

*****************************************************************************
}

begin
  assign(outfile,'elecolor.dir');
  rewrite(outfile);
  writeln(outfile,'  . data for element color prom 5/11/87');
  writeln(outfile,'  BITWIDTH = 8 BASE = 2  ');
  for panel:=0 to 1 do
    for y0:=0 to 1 do
      for x:=0 to 1023 do
      begin
        process_address;
        process_data;
        write('*');
      end;
  close(outfile);
end.  {program elecolor}

program elcint(input,output

{
*****************************************************************************

this program computes the intensities needed for antialiasing of the color
     LCD graphics generator. intensities are a function of the type of panel,
     the slope of the line, the fractional output of the gate arrays, and
     sequence of the element within the slice across the line.

*****************************************************************************
}
{

         Modified 5/11/87 to match actual panel layout eg:  R G  rather than R G
                                (upper left corner)          B              G B


}
type
    direction=(shallow,steep);
    rowtype=(even,odd);
    paneltype=(quad,delta);

var
    intensity,fraction,seq:integer;
    row:rowtype;
    panel:paneltype;
    slope:direction;
    addr:lstring(13);
    data:lstring(8);
    intensity_matrix:array[1..6,1..8,shallow..steep,even..odd] of integer;
    datafile:text;

{
*****************************************************************************
procedure initialize_delta_matrix: builds lookup table for intensities
*****************************************************************************
}
```

```
procedure initialize_delta_matrix;

begin
            {count,error,direction}
  intensity_matrix[1,1,steep,even]:=2;     {even rows}
  intensity_matrix[4,1,steep,even]:=5;
  intensity_matrix[1,2,steep,even]:=2;
  intensity_matrix[4,2,steep,even]:=5;
  intensity_matrix[1,3,steep,even]:=2;
  intensity_matrix[4,3,steep,even]:=5;

  intensity_matrix[1,4,steep,even]:=1;
  intensity_matrix[4,4,steep,even]:=6;
  intensity_matrix[1,5,steep,even]:=1;       {group 1}
  intensity_matrix[4,5,steep,even]:=6;
  intensity_matrix[1,6,steep,even]:=1;
  intensity_matrix[4,6,steep,even]:=6;
  intensity_matrix[1,7,steep,even]:=1;
  intensity_matrix[4,7,steep,even]:=6;

  intensity_matrix[1,8,steep,even]:=0;
  intensity_matrix[4,8,steep,even]:=7;

            {count,error,direction}

  intensity_matrix[2,1,steep,even]:=5;
  intensity_matrix[5,1,steep,even]:=2;

  intensity_matrix[2,2,steep,even]:=4;
  intensity_matrix[5,2,steep,even]:=3;
  intensity_matrix[2,3,steep,even]:=4;
  intensity_matrix[5,3,steep,even]:=3;
  intensity_matrix[2,4,steep,even]:=4;
  intensity_matrix[5,4,steep,even]:=3;

  intensity_matrix[2,5,steep,even]:=3;     {group 2}
  intensity_matrix[5,5,steep,even]:=4;
  intensity_matrix[2,6,steep,even]:=3;
  intensity_matrix[5,6,steep,even]:=4;
  intensity_matrix[2,7,steep,even]:=3;
  intensity_matrix[5,7,steep,even]:=4;
  intensity_matrix[2,8,steep,even]:=3;
  intensity_matrix[5,8,steep,even]:=4;

          {count,error,direction}

  intensity_matrix[3,1,steep,even]:=7;
  intensity_matrix[6,1,steep,even]:=0;
  intensity_matrix[3,2,steep,even]:=7;
  intensity_matrix[6,2,steep,even]:=0;

  intensity_matrix[3,3,steep,even]:=6;
  intensity_matrix[6,3,steep,even]:=1;
  intensity_matrix[3,4,steep,even]:=6;     {group 3}
  intensity_matrix[6,4,steep,even]:=1;
  intensity_matrix[3,5,steep,even]:=6;
  intensity_matrix[6,5,steep,even]:=1;
  intensity_matrix[3,6,steep,even]:=6;
  intensity_matrix[6,6,steep,even]:=1;

  intensity_matrix[3,7,steep,even]:=5;
  intensity_matrix[6,7,steep,even]:=2;
  intensity_matrix[3,8,steep,even]:=5;
  intensity_matrix[6,8,steep,even]:=2;

            {count,error,direction}

  intensity_matrix[1,1,steep,odd]:=1;   {odd rows}
  intensity_matrix[4,1,steep,odd]:=6;
  intensity_matrix[1,2,steep,odd]:=1;
  intensity_matrix[4,2,steep,odd]:=6;
  intensity_matrix[1,3,steep,odd]:=1;
  intensity_matrix[4,3,steep,odd]:=6;
```

```
intensity_matrix[1,4,steep,odd]:=0;  {group 1}
intensity_matrix[4,4,steep,odd]:=7;

intensity_matrix[1,5,steep,odd]:=2;
intensity_matrix[4,5,steep,odd]:=5;
intensity_matrix[1,6,steep,odd]:=2;
intensity_matrix[4,6,steep,odd]:=5;
intensity_matrix[1,7,steep,odd]:=2;
intensity_matrix[4,7,steep,odd]:=5;

intensity_matrix[1,8,steep,odd]:=1;
intensity_matrix[4,8,steep,odd]:=6;

        {count,error,direction,row position}

intensity_matrix[2,1,steep,odd]:=3;
intensity_matrix[5,1,steep,odd]:=4;
intensity_matrix[2,2,steep,odd]:=3;
intensity_matrix[5,2,steep,odd]:=4;
intensity_matrix[2,3,steep,odd]:=3;
intensity_matrix[5,3,steep,odd]:=4;
intensity_matrix[2,4,steep,odd]:=3;    {group 2}
intensity_matrix[5,4,steep,odd]:=4;

intensity_matrix[2,5,steep,odd]:=5;
intensity_matrix[5,5,steep,odd]:=2;

intensity_matrix[2,6,steep,odd]:=4;
intensity_matrix[5,6,steep,odd]:=3;
intensity_matrix[2,7,steep,odd]:=4;
intensity_matrix[5,7,steep,odd]:=3;
intensity_matrix[2,8,steep,odd]:=4;
intensity_matrix[5,8,steep,odd]:=3;

      {count,error,direction,row position}

intensity_matrix[3,1,steep,odd]:=6;
intensity_matrix[6,1,steep,odd]:=1;
intensity_matrix[3,2,steep,odd]:=6;
intensity_matrix[6,2,steep,odd]:=1;

intensity_matrix[3,3,steep,odd]:=5;
intensity_matrix[6,3,steep,odd]:=2;
intensity_matrix[3,4,steep,odd]:=5;  {group 3}
intensity_matrix[6,4,steep,odd]:=2;

intensity_matrix[3,5,steep,odd]:=7;
intensity_matrix[6,5,steep,odd]:=0;
intensity_matrix[3,6,steep,odd]:=7;
intensity_matrix[6,6,steep,odd]:=0;

intensity_matrix[3,7,steep,odd]:=6;
intensity_matrix[6,7,steep,odd]:=1;
intensity_matrix[3,8,steep,odd]:=6;
intensity_matrix[6,8,steep,odd]:=1;

          {end of steep lines}
          {count,error,direction,column position}

intensity_matrix[1,1,shallow,even]:=2;  {group 1 even columns}
intensity_matrix[3,1,shallow,even]:=6;
intensity_matrix[5,1,shallow,even]:=3;

intensity_matrix[1,2,shallow,even]:=2;
intensity_matrix[3,2,shallow,even]:=6;
intensity_matrix[5,2,shallow,even]:=3;

intensity_matrix[1,3,shallow,even]:=2;
intensity_matrix[3,3,shallow,even]:=6;
intensity_matrix[5,3,shallow,even]:=3;

intensity_matrix[1,4,shallow,even]:=2;
```

```
intensity_matrix[3,4,shallow,even]:=6;
intensity_matrix[5,4,shallow,even]:=3;

intensity_matrix[1,5,shallow,even]:=2;
intensity_matrix[3,5,shallow,even]:=6;
intensity_matrix[5,5,shallow,even]:=3;

intensity_matrix[1,6,shallow,even]:=1;
intensity_matrix[3,6,shallow,even]:=6;
intensity_matrix[5,6,shallow,even]:=4;

intensity_matrix[1,7,shallow,even]:=1;
intensity_matrix[3,7,shallow,even]:=6;
intensity_matrix[5,7,shallow,even]:=4;

intensity_matrix[1,8,shallow,even]:=1;
intensity_matrix[3,8,shallow,even]:=6;
intensity_matrix[5,8,shallow,even]:=4;

          {count,error,direction,column}

intensity_matrix[2,1,shallow,even]:=4;  {group 2}
intensity_matrix[4,1,shallow,even]:=6;
intensity_matrix[6,1,shallow,even]:=1;

intensity_matrix[2,2,shallow,even]:=4;
intensity_matrix[4,2,shallow,even]:=6;
intensity_matrix[6,2,shallow,even]:=1;

intensity_matrix[2,3,shallow,even]:=4;
intensity_matrix[4,3,shallow,even]:=6;
intensity_matrix[6,3,shallow,even]:=1;

intensity_matrix[2,4,shallow,even]:=4;
intensity_matrix[4,4,shallow,even]:=6;
intensity_matrix[6,4,shallow,even]:=1;

intensity_matrix[2,5,shallow,even]:=3;
intensity_matrix[4,5,shallow,even]:=6;
intensity_matrix[6,5,shallow,even]:=2;

intensity_matrix[2,6,shallow,even]:=3;
intensity_matrix[4,6,shallow,even]:=6;
intensity_matrix[6,6,shallow,even]:=2;

intensity_matrix[2,7,shallow,even]:=3;
intensity_matrix[4,7,shallow,even]:=6;
intensity_matrix[6,7,shallow,even]:=2;

intensity_matrix[2,8,shallow,even]:=3;
intensity_matrix[4,8,shallow,even]:=6;
intensity_matrix[6,8,shallow,even]:=2;

          {count,error,direction,column position}

intensity_matrix[1,1,shallow,odd]:=2;  {group 1 odd columns}
intensity_matrix[3,1,shallow,odd]:=6;
intensity_matrix[5,1,shallow,odd]:=3;

intensity_matrix[1,2,shallow,odd]:=2;
intensity_matrix[3,2,shallow,odd]:=6;
intensity_matrix[5,2,shallow,odd]:=3;

intensity_matrix[1,3,shallow,odd]:=2;
intensity_matrix[3,3,shallow,odd]:=6;
intensity_matrix[5,3,shallow,odd]:=3;

intensity_matrix[1,4,shallow,odd]:=2;
intensity_matrix[3,4,shallow,odd]:=6;
intensity_matrix[5,4,shallow,odd]:=3;
```

```
intensity_matrix[1,6,shallow,odd]:=1;
intensity_matrix[3,6,shallow,odd]:=6;
intensity_matrix[5,6,shallow,odd]:=4;

intensity_matrix[1,7,shallow,odd]:=1;
intensity_matrix[3,7,shallow,odd]:=6;
intensity_matrix[5,7,shallow,odd]:=4;

intensity_matrix[1,8,shallow,odd]:=1;
intensity_matrix[3,8,shallow,odd]:=6;
intensity_matrix[5,8,shallow,odd]:=4;

          {count,error,direction,column}

intensity_matrix[2,1,shallow,odd]:=4;  {group 2}
intensity_matrix[4,1,shallow,odd]:=6;
intensity_matrix[6,1,shallow,odd]:=1;

intensity_matrix[2,2,shallow,odd]:=4;
intensity_matrix[4,2,shallow,odd]:=6;
intensity_matrix[6,2,shallow,odd]:=1;

intensity_matrix[2,3,shallow,odd]:=4;
intensity_matrix[4,3,shallow,odd]:=6;
intensity_matrix[6,3,shallow,odd]:=1;

intensity_matrix[2,4,shallow,odd]:=4;
intensity_matrix[4,4,shallow,odd]:=6;
intensity_matrix[6,4,shallow,odd]:=1;

intensity_matrix[2,5,shallow,odd]:=3;
intensity_matrix[4,5,shallow,odd]:=6;
intensity_matrix[6,5,shallow,odd]:=2;

intensity_matrix[2,6,shallow,odd]:=3;
intensity_matrix[4,6,shallow,odd]:=6;
intensity_matrix[6,6,shallow,odd]:=2;

intensity_matrix[2,7,shallow,odd]:=3;
intensity_matrix[4,7,shallow,odd]:=6;
intensity_matrix[6,7,shallow,odd]:=2;

intensity_matrix[2,8,shallow,odd]:=3;
intensity_matrix[4,8,shallow,odd]:=6;
intensity_matrix[6,8,shallow,odd]:=2;

end;  {procedure initialize_delta_matrix}


{
*****************************************************************************
procedure set_intensity: sets the intensity bits of the color word
*****************************************************************************
}

procedure set_intensity;


begin
  case panel of
    delta:case slope of      {modified 5/11/87 for proper panel spec.}
            steep:case row of
                    even:intensity:=intensity_matrix[seq,fraction,slope,odd];
                    odd:intensity:=intensity_matrix[seq,fraction,slope,even];
                  end;  {case row...}

                      shallow
  intensity_matrix[1,5,[illegible],odd]:=2;
  intensity_matrix[3,5,shallow,odd]:=6;
  intensity_matrix[5,5,shallow,odd]:=3;
```

```
          shallow:intensity:=intensity_matrix[seq,fraction,slope,row];
        end;  {case slope...}
    quad:intensity:=intensity_matrix[seq,fraction,shallow,row];
  end;  {case}
end;  {procedure set_intensity}


{
*****************************************************************************
procedure process_data: outputs the desired intensity of the element
*****************************************************************************
}

procedure process_data;

var
    temp,index:integer;

begin
  data:='00000000';
  set_intensity;
  temp:=intensity;
  for index:=0 to 2 do
  begin
    if (temp mod 2 =1) then data[8-index]:='1';
    temp:=temp div 2;
  end;  {for}
  writeln(datafile,addr,data);
end;  {procedure process_data}

{
*****************************************************************************
procedure process_address: converts the prom address to ascii
*****************************************************************************
}

procedure process_address;

var
    temp,index:integer;

begin
  addr:=' 00000000000/';
  temp:=fraction-1;
  for index:=0 to 2 do
  begin
    if (temp mod 2 =1) then addr[12-index]:='1';
    temp:=temp div 2;
  end;  {for}
  temp:=seq-1;
  for index:=0 to 2 do
  begin
    if (temp mod 2 =1) then addr[9-index]:='1';
    temp:=temp div 2;
  end;  {for}
  if slope=steep then addr[6]:='1';
  if row=odd then addr[5]:='1';
  if panel=delta then addr[4]:='1';
end;  {procedure process_address}


{
*****************************************************************************

                        MAIN PROGRAM

*****************************************************************************
}

begin
  initialize_delta_matrix;        {establish intensity values}
  assign(datafile,'eleint.dir');
```

```
  rewrite(datafile);
  writeln( datafile,' . data for element intensity prom 5\11\87');
  writeln(datafile,' BITWIDTH = 8 , BASE = 2');
  for panel:=quad to delta do
    for row:=even to odd do
      for slope:= shallow to steep do
        for seq:=1 to 6 do
          for fraction:=1 to 8 do
          begin
            process_address;
            process_data;
            write('*');
          end;
  close(datafile);
end.  {program}
program inpfsm(input,output);

{
*****************************************************************************

     this program generates the files required to blow the two proms
     used as an input control finite state machine for the color LCD
     graphics generator. the proms used are 2k x 8 CMOS registered
     EPROMS cy7c245

     Modified 5/11/87 to conform to actual panel

*****************************************************************************
}

var
    dsteep,panel,iy0,int,steep,seq:integer;
    addstr:lstring(12);
    lobyte,hibyte:lstring(8);
    lofile,hifile:text;

value
    lobyte:='00000000';
    hibyte:='00000000';


{
*****************************************************************************
procedure gen_add_str: generates the ascii for the address portion of the
                       output string
*****************************************************************************
}

procedure gen_add_str;

var
    quo,temp:integer;

begin
  addstr:=' 0000000000/';
  temp:=seq;        {first bit of sequence}
  if (temp div 4 = 1 ) then
  begin
    addstr[9]:='1';
    temp:=temp-4;
  end;  {if}
  if (temp div 2 = 1) then
  begin
    addstr[10]:='1';
    temp:=temp-2;
  end;  {if}
  temp:= temp mod 2;
  if temp=1 then addstr[11]:='1';
  if steep=1 then addstr[8]:='1';
  temp:=int;              { intensity bits }
  if (temp div 4 = 1 ) then
  begin
```

```
    addstr[5]:='1';
    temp:=temp-4;
  end;  {if}
  if (temp div 2 = 1) then
  begin
    addstr[6]:='1';
    temp:=temp-2;
  end;  {if}
  temp:= temp mod 2;
  if temp=1 then addstr[7]:=[illegible]';
  if iy0=1 then addstr[4]:=[illegible]';
  if panel=1 then addstr[3]:='1';
  if dsteep=1 then addstr[2]:='1';
end;  {procedure gen_add_str}


{
*****************************************************************************
procedure gen_lo_byte: assembles the proper data for the low prom
*****************************************************************************
}

procedure gen_lo_byte;

var
    temp:integer;

begin
  lobyte:='00000000';
  temp:=(seq+1) mod 6;
  if (temp div 4 = 1 ) then
  begin
    lobyte[6]:='1';          {update sequence count}
    temp:=temp-4;
  end;  {if}
  if (temp div 2 = 1) then
  begin
    lobyte[7]:='1';
    temp:=temp-2;
  end;  {if}
  temp:= temp mod 2;
  if temp=1 then lobyte[8]:='1';
  if ((dsteep=1) and not(seq=4)) then lobyte[5]:='1';   {incx}
  if ((seq=4) and (steep=1)) then                 {k0x,k1x}
    case panel of
      0:lobyte[3]:='1';                    { quad panel-always subtract 2}
      1:case iy0 of                         {delta panel}
          1:lobyte[3]:='1';                  {odd row-truncate}
          0:case int of                            {even row-round}
               0..3:begin
                       lobyte[4]:='1';
                       lobyte[3]:='1';
                     end;  {round up}
               4..7:lobyte[3]:='1';       {round down}
            end;  {steep line,delta panel, odd row}
        end;  {inner case}
    end;  {outer case}
  writeln(lofile,addstr,lobyte);
end;  {procedure gen_lo_byte}

{
*****************************************************************************
procedure gen_hi_byte: generates data for the upper state machine prom
*****************************************************************************
}

procedure gen_hi_byte;

begin
  hibyte:='00000000';
  if seq=4 then
  begin
```

```
    hibyte[8]:='1';      {load}


    if steep=0 then hibyte[4]:='1';       {subtract 2}
  end;
  case seq of
    0..2:hibyte[7]:='1';
    otherwise
  end;  {case}
  if ((dsteep=0) and not(seq=4)) then hibyte[6]:='1';
  writeln(hifile,addstr,hibyte);
end;  {procedure gen_hi_byte}

{
*****************************************************************************

                        MAIN PROGRAM

*****************************************************************************
}

begin
  assign(lofile,'inpfsmlo.dir');
  assign(hifile,'inpfsmhi.dir');
  rewrite(lofile);
  writeln(lofile,'  . data for input  (low prom)  FSM  5\11\87');
  writeln(lofile,'  BITWIDTH = 8 , BASE = 2  .');
  rewrite(hifile);
  writeln(hifile,'  . data for input  (high prom)  FSM  5\11\87');
  writeln(hifile,'  BITWIDTH = 8 , BASE = 2   ');
  for dsteep:=0 to 1  do
    for panel:=0 to 1  do
      for iyC:=0 to 1  do
        for int:=0 to 7  do
          for steep:=0 to 1  do
            for seq:=0 to 5  do
            begin
              write('*');
              gen_add_str;
              gen_lo_byte;
              gen_hi_byte;
            end;
  close(lofile);
  close(hifile);
end.

PARTNO none;
NAME Lsaddseq;
REV 00;
DATE 3/20/87;
DESIGNER Scott Bottorf;
COMPANY Collins Government Avionics;
ASSEMBLY color LCD graphics generator;
LOCATION Uxx;
DEVICE C22v10;

/*****************************************************************************/
/* The least significant part of the element address sequencers              */
/*****************************************************************************/

/*      ALLOWABLE DEVICE TYPES C22v10        */

/*      ********** INPUTS **********         */

PIN 1 = CLK        ;/* 10MHz WRITE CIRCUIT CLOCK              */
PIN 2 = A3         ;/* MOST SIGNIFICANT ADDRESS INPUT         */
PIN 3 = A2         ;
PIN 4 = A1         ;
PIN 5 = A0         ;/* LEAST SIGNIFICANT ADDRESS BIT          */
PIN 6 = L          ;/* LOAD ENABLE (active high)              */
```

```
PIN 7 = I          ;/* INCREMENT ENABLE                    */
PIN 8 = K1         ;/* MSB OF DECREMENT CODE               */
PIN 9 = K0         ;/* LSB OF DECREMENT CODE               */

/**********************/
/*    K1,K0   VALUE   */
/*     0  0     0     */
/*     1  1    -1     */
/*     1  0    -2     */
/*     0  1  INVALID  */
/**********************/

/*      ********** OUTPUTS ***********        */

PIN 19 = Q3        ;/* MOST SIGNIFICANT OUTPUT BIT         */
PIN 18 = Q2        ;
PIN 17 = Q1        ;
PIN 20 = Q0        ;/* LEAST SIGNIFICANT OUTPUT BIT        */
PIN 21 = C         ;/* CARRY OUT (to msaddseq)             */

/*     ******** INTERMEDIATE  VARIABLES ***********         */

B = K1&!K0 # K1&K0&!A0      ;
BBAR = !K1&!K0 # K1&K0&A0  ;

/*     ******** LOGIC EQUATIONS  **********                 */

Q3.D = L&(!A3&B&!A2&!A1 # A3&(BBAR#A2#A1)) #
       !L&I&(!Q3&Q2&Q1&Q0 # Q3&(!Q2#!Q1#!Q0)) #
       !L&!I&Q3                                        ;

Q2.D = L&(!A2&B&!A1 # A2&(BBAR#A1)) #
       !L&I&(!Q2&Q1&Q0 # Q2&(!Q1#!Q0)) #
       !L&!I&Q2                                        ;

Q1.D = L&(B&!A1 # A1&BBAR) #
       !L&I&(!Q1&Q0 # Q1&!Q0) #
       !L&!I&Q1                                        ;

Q0.D = L&(A0&!K0 # !A0&K0) #
       !L&I&!Q0 #
       !L&!I&Q0                                        ;

C = !L&I&Q3&Q2&Q1&Q0 # L&(K1&!K0&!A3&!A2&!A1 # K1&K0&!A3&!A2&!A1&!A0) ;

PARTNO none;
NAME Msaddseq;
REV 00;
DATE 3/20/87,
DESIGNER Scott Botterf;
COMPANY Collins Government Avionics;
ASSEMBLY color LCD graphics generator;
LOCATION Uxx;
DEVICE C22v10;

/*************************************************************************/
/*  The most significant part of the element address sequencers. Used in    */
/*      conjunction with Lsaddseq part to form a 10 bit load-and-decrement  */
/*      hold, or increment register for sequencing through a 6 element slice */
/*************************************************************************/

/*      ALLOWABLE DEVICE TYPES: C22v10          */

/*      ******** inputs ********                */

PIN 1 = CLK        ;/* 10 MHz WRITE CIRCUIT CLOCK          */
PIN 2 = A5         ;/* MOST SIGNIFICANT INPUT BIT          */
PIN 3 = A4         ;
PIN 4 = A3         ;
PIN 5 = A2         ;
PIN 6 = A1         ;
PIN 7 = A0         ;
```

```
PIN 8 = C            ;/* CARRY IN                                    */
PIN 9 = L            ;/* LOAD ENABLE (active high)                   */
PIN 10 = I           ;/* INCREMENT ENABLE                            */

/*     ******** outputs ********                  */

PIN 19 = Q5          ;/* MOST SIGNIFICANT OUTPUT BIT                 */
PIN 18 = Q4          ;
PIN 17 = Q3          ;
PIN 20 = Q2          ;
PIN 21 = Q1          ;
PIN 16 = Q0          ;/* LEAST SIGNIFICANT                           */

/*     ****** no intermediate variables ******  */

/*     ******** logic equations ********        */

/* outputs always enabled */

Q5.D = L&(!A5&C&!A4&!A3&!A2&!A1&!A0 # A5&(!C#A4#A3#A2#A1#A0)) #
       !L&I&C&(!Q5&Q4&Q3&Q2&Q1&Q0 # Q5(!Q4#!Q3#!Q2#!Q1#!Q0))  #
       !L(!I#!C)&Q5                                             ;

Q4.D = L&(!A4&C&!A3&!A2&!A1&!A0 # A4&(!C#A3#A2#A1#A0)) #
       !L&I&C&(!Q4&Q3&Q2&Q1&Q0 # Q4(!Q3#!Q2#!Q1#!Q0))  #
       !L(!I#!C)&Q4                                             ;

Q3.D = L&(!A3&C&!A2&!A1&!A0 # A3&(!C#A2#A1#A0)) #
       !L&I&C&(!Q3&Q2&Q1&Q0 # Q3(!Q2#!Q1#!Q0))  #
       !L(!I#!C)&Q3                                             ;

Q2.D = L&(!A2&C&!A1&!A0 # A2&(!C#A1#A0)) #
       !L&I&C&(!Q2&Q1&Q0 # Q2(!Q1#!Q0))  #
       !L(!I#!C)&Q2                                             ;

Q1.D = L&(!A1&C&!A0 # A1&(!C#A0)) #
       !L&I&C&(!Q1&Q0 # Q1&!Q0))  #
       !L(!I#!C)&Q1

Q0.D = L&(C&!A0 # !C&A0) #
       !L&I&C&(!Q0))  #
       !L(!I#!C)&Q0

program writen(input,output


{
*****************************************************************************

this program generates the  data for the write enable and intensity pipeline
     prom. the inputs are element color, desired line color, antialiased
     intensity value, and two validity bits

     modified to produce jaggy lines for colors 8-15     11 Sep 1987


*****************************************************************************
}

var
    elc,eli,color,valid:integer;
    addr:lstring(13);
    data:lstring(8);
    outfile:text;


{
*****************************************************************************
procedure process_address: generates the address field of the output line
*****************************************************************************
}
```

```
procedure process_address;

var
    temp,index:integer;

begin
  addr:=' 00000000000/';
  data:='00000111';
  temp:=elc;
  if (temp mod 2 =1) then addr[12]:='1';
  temp:=temp div 2;
  if (temp mod 2 =1) then addr[11]:='1';
  temp:=eli;
  for index:=0 to 2 do
  begin
    if (temp mod 2 =1) then
    begin
      addr[10-index]:='1';
      data[8-index]:='0';      {same field used for output data}
    end;  {if}
    temp:=temp div 2;
  end;  {for}
  temp:=color;
  for index:=0 to 3 do
  begin
    if (temp mod 2 =1) then addr[7-index]:='1';
    temp:=temp div 2;
  end;  {for};
  temp:=valid;
  if (temp mod 2 =1) then addr[3]:='1';
  temp:=temp div 2;
  if (temp mod 2 =1) then addr[2]:='1';
end;  {procedure process_address}

{
*****************************************************************************
procedure process_data: gene  tes the write enable sign.    NOTE: the intensity
                        output is created in the address procedure.
*****************************************************************************
}

procedure process_data;

var index:integer;

begin
  if ((eli<>0) and (valid<>3)) then
    case (color mod 8) of
      1:if elc=0 then data[5]:='1';
      2:if elc=1 then data[5]:='1';
      3:if ((elc=0) or (elc=1)) then data[5]:='1';
      4:if elc=2 then data[5]:='1';
      5:if ((elc=0) or (elc=2)) then data[5]:='1';
      6:if ((elc=1) or (elc=2)) then data[5]:='1';
      7:data[5]:='1';
      otherwise
    end;  {case}
    if ((color=8) and (valid<>3)) then          {always write jaggy black}
    begin
      data[5]:='1';   {write bit}
      data[6]:='1';   {zero intensity}
      data[7]:='1';
      data[8]:='1';
    end;
    if (color>9)
      then for index:=0 to 2 do data[6+index]:='0';
    writeln(outfile,addr,data);
end;  {procedure process_data}

{
```

**********

MAIN PROGRAM

**********

```
}

begin
  assign(outfile,'writen.dir');
  rewrite(outfile);
  for valid:=0 to 3 do
    for color:=0 to 15 do
      for eli:=0 to 7 do
        for elc:=0 to 3 do
        begin
          process_address;
          process_data;
          write('*');
        end;
  close(outfile);
end.  {program writen}
```

I claim:

1. An apparatus for drawing line of a predetermined desired color and at a predetermined desired position, on a color matrix display comprising:

a. means for receiving line position and slope information;

b. means for registering the line position and slope information;

c. means for centering an array of elements around the predetermined line position information;

d. means for determining the color of elements in the array of elements;

e. means for determining an intensity of each element in the array of elements in order to produce the predetermined position of the line; and f. means for providing an intensity for each element in the array of elements in order to provide the desired line color.

2. An apparatus of claim 1 wherein said means for receiving predetermined line position and slope information further comprises a PROM.

3. An apparatus of claim 2 wherein said means for registering the line position and slope information further comprises means for providing a pipeline stage for the line color, validity and slope.

4. An apparatus of claim 3 wherein said means for centering an array of elements around the predetermined line and slope position information further comprises means for directly loading and holding an independent variable while a dependent variable is loaded with a subtract and then incremented to generate an address for each element.

5. An apparatus of claim 4 wherein said means for determining the color of element in the array of elements further comprises a PROM for receiving an X address and the least significant bit of a Y address from the means for centering an array of elements, and a panel bit and determining the color of the addressed element.

6. An apparatus of claim 5 wherein said means for determining an intensity of each element in the array of elements in order to produce the predetermined position of the line further comprises a PROM for receiving the slope and inverted intensity bits, the panel bit, and the Y least significant bit for determining an intensity for anti-aliasing of the addressed element without regard to the predetermined line color.

7. A method for drawing lines on a color matrix display comprising the steps of:

a. generating line, position and slope information for a given line segment in response to an input signal;

b. receiving the line, position and slope information;

c. registering the line position and slope information;

d. centering an array of elements around the line and slope position information;

e. determining the color of elements in the array of elements;

f. determining an intensity of each element in the array of elements in order to produce the predetermined position of the line; and g. providing an intensity for each element and the array of elements in order to provide the predetermined line color.

8. A color matrix display comprising:

a. a matrix of individually addressable elements for generating portions of an image;

b. vector generator means for generating element intensity, position and line slope information for a given line segment in response to an input signal;

c. input control means for receiving the element intensity, position and slope information;

d. pipeline stage means for inverting and registering the element intensity information;

e. address sequencer means for centering an array of elements around the element position information;

f. element color block means for determining the color of the elements corresponding to the element position information;

g. element intensity determining means for determining an intensity of each element in the array of elements in order to produce the predetermined position of the line; and h. color mixer means for providing an intensity of each element and the array of elements in order to provide the predetermined line color.

* * * * *